US007025050B2

(12) United States Patent
Oono et al.

(10) Patent No.: US 7,025,050 B2
(45) Date of Patent: Apr. 11, 2006

(54) FUEL PRESSURE CONTROL DEVICE FOR INTERNAL COMBINATION ENGINE

(75) Inventors: Takahiko Oono, Hyogo (JP); Toshiaki Date, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/998,589

(22) Filed: Nov. 30, 2004

(65) Prior Publication Data

US 2005/0263146 A1 Dec. 1, 2005

(30) Foreign Application Priority Data

May 28, 2004 (JP) ..... 2004-160022

(51) Int. Cl.
*F02D 41/14* (2006.01)
*F02D 41/22* (2006.01)

(52) U.S. Cl. ..... 123/690; 123/458; 123/447; 123/479

(58) Field of Classification Search ..... 123/294, 123/295, 305, 446, 447, 456, 457, 458, 459, 123/479, 480, 502, 690; 73/117.3, 119 A; 701/103, 104, 105
See application file for complete search history.

(56) References Cited

U.S. PATENT DOCUMENTS 5,941,214 A * 8/1999 Hoffmann et al. ..... 123/447
6,032,639 A * 3/2000 Goto et al. ..... 123/295
6,125,832 A * 10/2000 Toyohara et al. ..... 123/690
6,138,638 A * 10/2000 Morikawa ..... 123/295
6,283,108 B1 * 9/2001 Matsufuji et al. ..... 123/690
6,378,498 B1 * 4/2002 Kohketsu et al. ..... 123/447
6,792,912 B1 * 9/2004 Kikuchi et al. ..... 123/294
6,792,919 B1 * 9/2004 Kohketsu et al. ..... 123/447
6,868,826 B1 * 3/2005 Oono ..... 123/445
6,871,633 B1 * 3/2005 Date et al. ..... 123/447

FOREIGN PATENT DOCUMENTS

JP 10-176587 A 6/1998
JP 2000274322 A * 10/2000
JP 3233112 B2 9/2001

* cited by examiner

*Primary Examiner*—Willis R. Wolfe, Jr.
(74) *Attorney, Agent, or Firm*—Sughrue Mion, PLLC

(57) ABSTRACT

A fuel pressure control device includes a fuel injection valve, a pressure accumulation chamber for storing a high pressure fuel, a high pressure pump, a fuel pressure control valve, a fuel pressure sensor for detecting a fuel pressure PR in the pressure accumulation chamber, an air-fuel ratio sensor for detecting an air-fuel ratio condition, target value calculation means for calculating a target fuel pressure and a target air-fuel ratio AFo, fuel pressure control means for performing feedback control of the fuel pressure control valve such that the fuel pressure PR matches the target fuel pressure, abnormality diagnosis means for diagnosing the fuel pressure sensor, and fuel pressure estimation means for calculating an estimated fuel pressure PRs based on the air-fuel ratio condition when an abnormal condition occurs. The fuel pressure estimation means corrects the estimated fuel pressure PRs such that the air-fuel ratio condition is guided to the target air-fuel ratio AFo.

10 Claims, 8 Drawing Sheets

FUEL PRESSURE CONTROL DEVICE FOR INTERNAL COMBINATION ENGINE

BACKGROUND OF THE INVENTION

1. Field of the Invention

The present invention relates to a fuel pressure control device for an internal engine in which even if an abnormal condition occurs in a fuel pressure sensor in a high pressure fuel supply system, desired high fuel pressure control is continuously carried out by calculating an appropriate estimated fuel pressure based on an air-fuel ratio condition to achieve a reliable limp home mode (safe mode) operation.

2. Description of the Related Art

In one proposed conventional fuel pressure control device for an internal combustion engine, a high pressure fuel system including a high pressure pump for pressurizing a fuel at a high pressure and a fuel pressure sensor, and an ECU for performing feedback control such that the fuel pressure in a pressure accumulation chamber matches a target fuel pressure are provided. As fuel pressure control in the fuel pressure control device, if an abnormal condition occurs in the high pressure fuel system, a fuel pressure control valve is forcibly controlled such that the fuel pressure is adjusted to the maximum pressure (corresponding to the valve opening pressure of a relief valve as described later) for performing the safe mode operation (see JP 10-176587 A, for example).

Further, in another proposed conventional device, the fuel pressure control valve is forcibly controlled such that the fuel pressure in the pressure accumulation chamber is adjusted to the minimum pressure (corresponding to the adjustment pressure of a low pressure regulator as described later) for performing a safe mode operation (e.g., see JP 3,233,122 B).

In any of the above-mentioned conventional devices, when the fuel pressure sensor is in a normal condition, the drive pulse width of a fuel injection valve is corrected based on the fuel pressure detected by the fuel pressure sensor. Even if the fuel pressure changes, a predetermined amount of fuel is supplied to the internal combustion engine by injection.

However, when a failure occurs in the fuel pressure sensor, the correction of the fuel injection amount is not properly carried out. Therefore, an accidental fire or an engine stop may occur due to deviation of the air-fuel ratio. In order to avoid the circumstances, when a failure occurs in the fuel pressure sensor, the fuel pressure control valve is forcibly controlled such that the fuel pressure is adjusted to a known pressure, and the known pressure is used as an estimated fuel pressure to correct the drive pulse width for performing the safe mode operation.

That is, in the conventional device disclosed in JP 10-176587 A, when the abnormal condition of the sensor is detected, the fuel pressure feedback control is stopped, and the fuel pressure control valve is forcibly controlled such that the fuel pressure is adjusted to the maximum pressure. In the conventional device disclosed in JP 3,233,122 B, the fuel pressure feedback control is stopped, and the fuel pressure control valve is forcibly controlled such that the fuel pressure is adjusted to the minimum pressure.

The fuel injection amount corresponding to the drive pulse width of the fuel injection valve has nominal characteristics. In order to achieve the constant fuel amount at different fuel pressures, it is necessary to change the drive pulse width in correspondence with the fuel pressure. As the fuel pressure gets lower, the drive pulse width gets longer.

In consideration of the fuel injection at the minimum pressure, when an air intake valve is closed, since the compression pressure in a combustion chamber increases to a pressure equal to or greater than the minimum pressure, the fuel injection cannot be carried out. Further, since the injected fuel is released from an exhaust valve in the discharging process, expansion of the drive pulse width is constrained.

Therefore, in the case where the safe mode operation is carried out at the minimum pressure as disclosed in JP 3,233,122 B, the operation range of the safe mode operation is significantly limited due to the constraint.

Further, the injection amount corresponding to the drive pulse width varies depending on the individual difference between cylinders. Therefore, as disclosed in JP 10-176587 A, if the safe mode operation is carried out at the maximum pressure (>the fuel pressure by the normal feedback control), when the operation is carried out at a low load (idling operation, or deceleration operation), deviation between the injection amounts of the cylinders is large, and the reliable safe mode driving may not be achieved due to an accidental fire or an engine stop.

Moreover, in a period after switching to the forcible control for achieving the known pressure (the maximum pressure or the minimum pressure) until the actual fuel pressure is guided to the known pressure, the drive pulse width may be corrected erroneously due to the deviation amount between the known pressure and the actual fuel pressure, and an accidental fire or an engine stop may occur.

For example, in the case of JP 10-176587 A, in the period when the fuel pressure deviation occurs, i.e., in the period after the control is switched to the forcible control for achieving the maximum pressure until the actual fuel pressure is guided to the know pressure, since the maximum pressure is used as the estimated fuel pressure and the drive pulse width is erroneously corrected, the air-fuel ratio is deviated toward the lean condition to cause an accidental fire, and the rotational speed is lowered.

In the conventional fuel pressure control device for the internal combustion engine, in the case of JP 10-176587 A, when the abnormal condition occurs in the fuel pressure sensor, since the safe mode operation is carried out at the known maximum pressure, deviation in the injection amount at the time of low load operation is large, and thus, an accidental fire or an engine stop occurs. Therefore, it is not possible to carry out a reliable safe mode driving.

Also, in the case of JP 3,233,122 B, since the safe mode operation is carried out at the known minimum pressure, the operation range for the safe mode operation is significantly limited due to the constraint of the fuel injection period.

Furthermore, in the period after the control is switched to the forcible control for achieving the known pressure (the maximum pressure or the minimum pressure) until the actual fuel pressure is guided to the known pressure, deviation between the known pressure and the actual fuel pressure occurs. Thus, the drive pulse width is erroneously corrected, and an accidental fire or an engine stop occurs. Therefore, it is not possible to carry out a reliable safe mode driving.

SUMMARY OF THE INVENTION

The present invention has been made to solve the problems, and an object of the invention is provide a fuel pressure control device in which even if an abnormal condition of a fuel pressure sensor occurs, desired high pressure control is swiftly continued to reliably carry out a reliable safe mode operation.

According to the present invention, there is provided a fuel pressure control device for an internal combustion engine, including: a fuel injection valve for injecting a fuel directly into a combustion chamber of the internal combustion engine; a pressure accumulation chamber connected to the fuel injection valve for storing a high pressure fuel; a high pressure pump for pressurizing a low pressure fuel supplied from a fuel tank in a pressure chamber, and supplying the high pressure fuel to the pressure accumulation chamber; a fuel pressure control valve for controlling at least one of an amount of the fuel discharged from the high pressure pump to the pressure accumulation chamber and a fuel pressure in the pressure accumulation chamber; a fuel pressure sensor for detecting the fuel pressure in the pressure accumulation chamber; an air-fuel ratio sensor for detecting an air-fuel ratio condition in the internal combustion engine; target value calculation means for calculating a target fuel pressure and a target air-fuel ratio based on an operating condition of the internal combustion engine; fuel pressure control means for performing feedback control of the fuel pressure control valve such that the fuel pressure detected by the fuel pressure sensor matches the target fuel pressure; abnormality diagnosis means for diagnosing whether the fuel pressure sensor is in an abnormal condition or not; and fuel pressure estimation means for calculating an estimated pressure in the pressure accumulation chamber based on the air-fuel ratio condition when the abnormality diagnosis means diagnoses that the fuel pressure sensor is in the abnormal condition, in which the fuel pressure estimation means corrects the estimated fuel pressure such that the air-fuel ratio condition is guided to the target air-fuel ratio.

According to the present invention, when the fuel pressure sensor is diagnosed as being in the abnormal condition, the fuel pressure in a pressure accumulation chamber is estimated based on an air-fuel ratio condition, and fuel pressure control is continued based on the estimated pressure. The estimated pressure is corrected such that the air-fuel ratio condition is guided to a target air-fuel ratio. Therefore, the drive pulse width of a fuel injection valve is appropriately corrected by the highly accurate estimated fuel pressure value. Accordingly, a reliable safe mode operation can be carried out without any accidental fire or engine stop.

DESCRIPTION OF THE PREFERRED EMBODIMENTS

First Embodiment

Hereinafter, a general structure of a fuel pressure control device for an internal combustion engine according to a first embodiment of the present invention will be described with reference to FIGS. 1 and 2.

Figure 1:
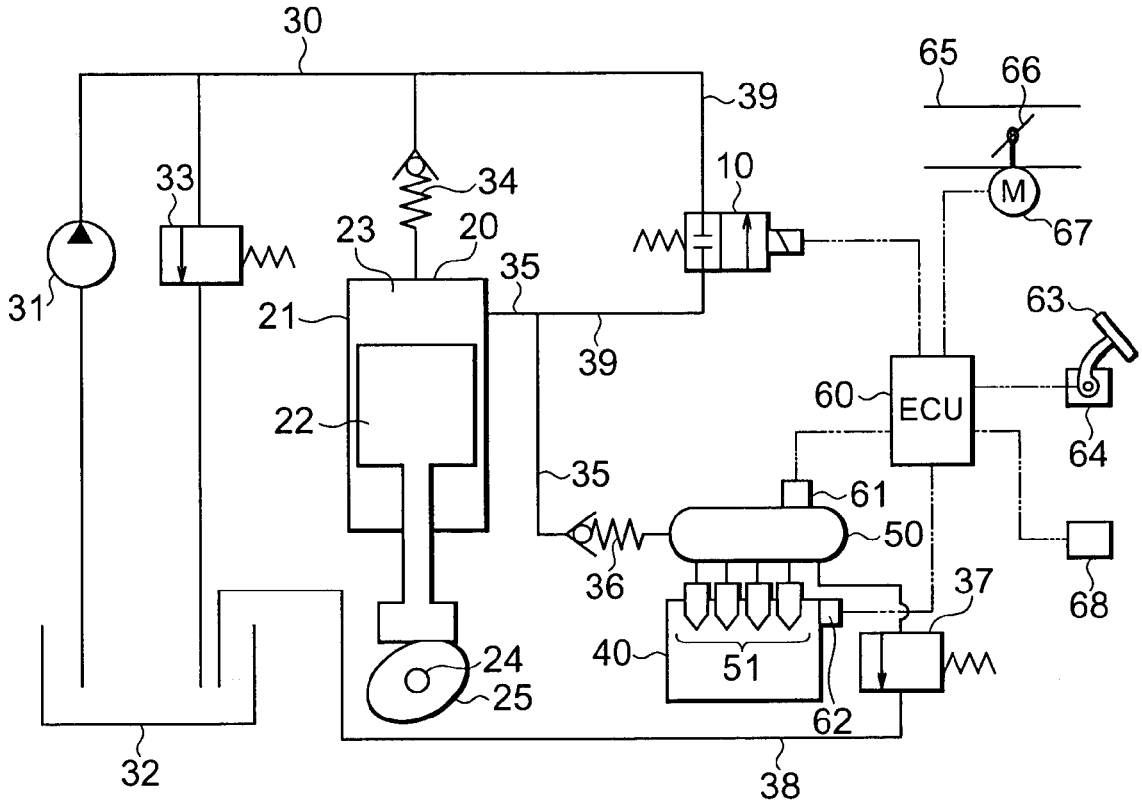
FIG. 1 is a block structural diagram schematically showing a fuel system of a fuel pressure control device for an internal combustion engine according to a first embodiment of the present invention.

FIG. 1 is a block structural diagram schematically showing a fuel system of the fuel pressure control device for the internal combustion engine according to the first embodiment of the present invention.

In FIG. 1, a high pressure pump 20 includes a cylinder 21, a plunger 22 which reciprocates in the cylinder 21, and a pressure chamber 23 defined by an inner wall surface of the cylinder 21 and an upper end surface of the plunger 22. The high pressure pump 20 pressurizes a low pressure fuel supplied from a fuel tank 32 at a high pressure, and supplies the fuel to a pressure accumulation chamber 50.

A lower end of the plunger 22 is in contact with a cam 25 under pressure. The cam 25 is provided at a camshaft 24 of the internal combustion engine. When the cam 25 rotates by rotation of the camshaft 24, the plunger 22 reciprocates in the cylinder 21 to change the volume in the pressure chamber 23.

An inlet passage 30 is connected to the pressure chamber 23 at a position upstream of the pressure chamber 23. The inlet passage 30 is connected to the fuel tank 32 through a low pressure pump 31.

The low pressure pump 31 sucks the fuel from the fuel tank 32, and discharges the fuel.

The pressure of the fuel discharged from the low pressure pump 31 is regulated at a predetermined low pressure value by a low pressure regulator 33. Then, when the plunger 22 moves downwardly in the cylinder 21, the fuel is supplied into the pressure chamber 23 through a check valve 34.

A supply passage 35 is connected to the pressure chamber 23 at a position downstream of the pressure chamber 23. The supply passage 35 is connected to a pressure accumulation chamber 50 through a check valve 36.

The pressure accumulation chamber 50 stores the high pressure fuel discharged from the pressure chamber 23, and distributes the high pressure fuel to a fuel injection valve 51. The fuel injection valve 51 connected to the pressure accumulation chamber 50 injects the high pressure fuel directly into a combustion chamber in the internal combustion engine. Further, the check valve 36 prevents the back flow of the fuel from the pressure accumulation chamber 50 to the pressure chamber 23.

A relief valve 37 connected to the pressure accumulation chamber 50 is a normally closed valve which opens at a predetermined valve opening pressure or more. When the fuel pressure in the pressure accumulation chamber 50 reaches the valve opening pressure, the relief valve 37 opens, and the fuel in the pressure accumulation chamber 50 flows back to the fuel tank 32 through a relief passage 38. In this manner, the excessively high fuel pressure in the pressure accumulation chamber 50 is prevented.

For example, a fuel pressure control valve 10 is a normally open type solenoid valve, and provided in a spill passage 39 connected in common to the supply passage 35.

The fuel pressure control valve 10 controls at least one of the amount of the fuel discharged from the high pressure pump 20 to the pressure accumulation chamber 50 and the fuel pressure in the pressure accumulation chamber 50.

When the plunger 22 moves upwardly in the cylinder 21, while the fuel pressure control valve 10 is open under control, the fuel discharged from the pressure chamber 23 to the supply passage 35 flows back to the inlet passage 30 through the spill passage 39. Therefore, the high pressure fuel is not supplied to the pressure accumulation chamber 50.

If the fuel pressure control valve 10 is closed under control while the plunger 22 is in the middle of moving upwardly, then, the pressurized fuel discharged from the pressure chamber 23 to the supply passage 35 is supplied to the pressure accumulation chamber 50 through the check valve 36.

A fuel pressure sensor 61 is connected to the pressure accumulation chamber 50, and outputs a detection signal in correspondence with the fuel pressure PR in the pressure accumulation chamber 50 to an ECU 60.

Further, detection signals from, e.g., a rotational speed sensor 62 for detecting the revolution number of an engine (internal combustion engine) 40 and an accelerator position sensor 64 for detecting the depression amount of an accelerator pedal 63 are inputted to the ECU 60.

The ECU 60 determines a target fuel pressure PO based on detection information (indicating the operating condition of the engine 40) from various sensors, and performs feedback control to open or close the fuel pressure control valve 10 such that the fuel pressure PR detected by the pressure sensor 61 matches the target fuel pressure PO.

Further, the ECU 60 controls a motor (throttle actuator) 67 such that the position of an electronically controlled throttle valve (hereinafter simply referred to as the "throttle valve") 66 provided in an intake pipe passage 65 of the engine 40 is adjusted to a predetermined position in correspondence with the detection signal outputted from the accelerator position sensor 64.

An air-fuel ratio sensor 68 provided in an exhaust air pipe of the engine 40 detects an air-fuel ratio condition corresponding to an actual air-fuel ratio AFr of the engine 40.

The first embodiment according to the present invention is not only applicable to the structure shown in FIG. 1, but also applicable to a so called high pressure spill type fuel pressure control device where the spill passage 39 is connected between the check valve 36 and the pressure accumulation chamber 50, and the fuel pressure control valve 10 is disposed in the spill passage 39.

Figure 2:
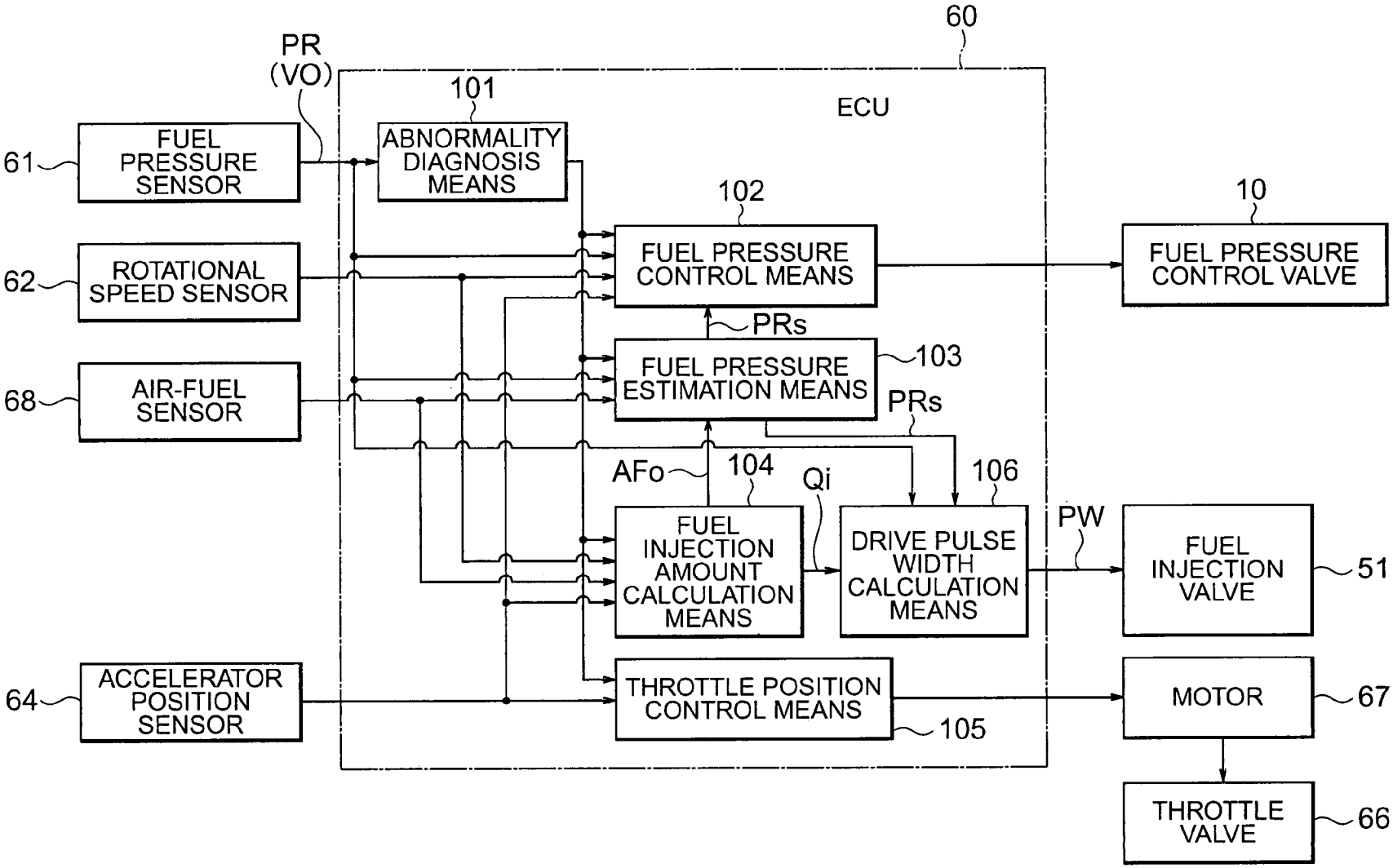
FIG. 2 is a block diagram showing a functional structure of an ECU using the fuel pressure control device for the internal combustion engine according to the first embodiment of the present invention.

FIG. 2 is a block diagram showing a functional structure of the ECU 60 using the fuel pressure control device for the internal combustion engine according to the first embodiment of the present invention.

In FIG. 2, the ECU 60 includes abnormality diagnosis means 101, fuel pressure control means 102, fuel pressure estimation means 103, fuel injection amount calculation means 104, throttle position control means 105, and drive pulse width calculation means 106.

Based on information as to whether the fuel pressure PR detected by the fuel pressure sensor 61 indicates an abnormal value or not, the abnormality diagnosis means 101 diagnoses whether the fuel pressure sensor 61 is in an abnormal condition or not, and transmits the diagnosis result to the fuel pressure control means 102, the fuel pressure estimation means 103, the fuel injection amount calculation means 104, and the throttle position control means 105.

For example, if the abnormality diagnosis means 101 determines that the fuel pressure sensor 61 is not in the abnormal condition, the fuel pressure control means 102, the fuel injection amount calculation means 104, and the throttle position control means 105 carry out the following normal control processes, respectively.

That is, the fuel pressure control means 102 includes target fuel pressure calculation means for calculating the target fuel pressure in correspondence with the operating condition of the engine 40. The fuel pressure control means 102 obtains various items regarding sensor information (operating condition information of the engine 40) from the fuel pressure sensor 61, the rotational speed sensor 62, and the accelerator position sensor 64, and determines the target fuel pressure PO based on those items regarding operating condition information.

Further, the fuel pressure control means 102 performs feedback control to open or close the fuel pressure control valve 10 such that the fuel pressure PR in the pressure accumulation chamber 50 (see FIG. 1) detected by the pressure sensor 61 matches the target fuel pressure PO.

The fuel injection amount calculation means 104 obtains various items regarding sensor information (operating condition information of the engine 40) from the rotational speed sensor 62, the air-fuel ratio sensor 68, and the accelerator position sensor 64, and calculates the fuel injection amount (target value) Qi based on those items regarding operating condition information.

The fuel injection amount calculation means 104 includes a target air-fuel ratio calculation means for calculating a target air-fuel ratio AFo in correspondence with the operation condition of the engine 40, and calculates the target air-fuel ratio AFo based on detection information (operating condition) from at least the rotational sensor 62 and the accelerator position sensor 64.

The drive pulse width calculation means 106 calculates a drive pulse width PW of the fuel injection valve 51 based on the fuel injection amount Qi calculated by the fuel injection amount calculation means 104 and the fuel pressure PR detected by the fuel pressure sensor 61, and drives the fuel injection valve 51 under control using the drive pulse width PW in correspondence with the fuel injection amount Qi.

Further, the throttle position control means 105 drives a motor 67 to control the throttle valve 66 such that the position of the throttle valve 66 is adjusted to a predetermined position in correspondence with the detection signal from the accelerator position sensor 64.

If the abnormality diagnosis means 101 diagnoses that the fuel pressure sensor 61 is in the abnormal condition, the fuel pressure control means 102 performs feedback control to open or close the fuel pressure control valve 10 such that the fuel pressure estimated by the fuel pressure estimation means 103 matches the target fuel pressure PO determined based on the operating condition information of the engine 40 (or an abnormal condition target fuel pressure used when the fuel pressure sensor 61 is in the abnormal condition).

At this time, if the abnormality diagnosis means 101 diagnoses that the fuel pressure sensor 61 is in the abnormal condition, the fuel pressure estimation means 103 sets a detection value of the fuel pressure PR stored before the determination of the abnormal condition of the fuel pressure sensor 61 as an initial value of an estimated fuel pressure PRs, calculates an estimated pressure PRs in the pressure accumulation chamber 50 based on the air-fuel ratio condition detected by the air-fuel ratio sensor 68, and corrects the estimated fuel pressure PRs such that the detected air-fuel ratio condition (e.g., an actual air-fuel ratio condition AFr) is guided to the target air-fuel ratio condition AFo (which is set based on the operating condition information).

Further, the fuel injection amount calculation means 104 calculates the fuel injection amount Qi based on the operating condition information from the various sensors, and the drive pulse width calculation means 106 calculates the drive pulse width PW based on the estimated fuel pressure PRs calculated by the fuel pressure estimation means 103 and the fuel injection amount Qi calculated by the fuel injection amount calculation means 104 to drive the fuel injection valve 51 under control.

Moreover, if the abnormality diagnosis means 101 determines that the fuel pressure sensor 61 is in the abnormal condition, the throttle position control means 105 carries out a filtering process to the detection result from the accelerator position sensor 64, and drives_the motor 67 under control such that the position of the throttle valve 66 matches the position in correspondence with the value after the filtering process.

Figure 3:
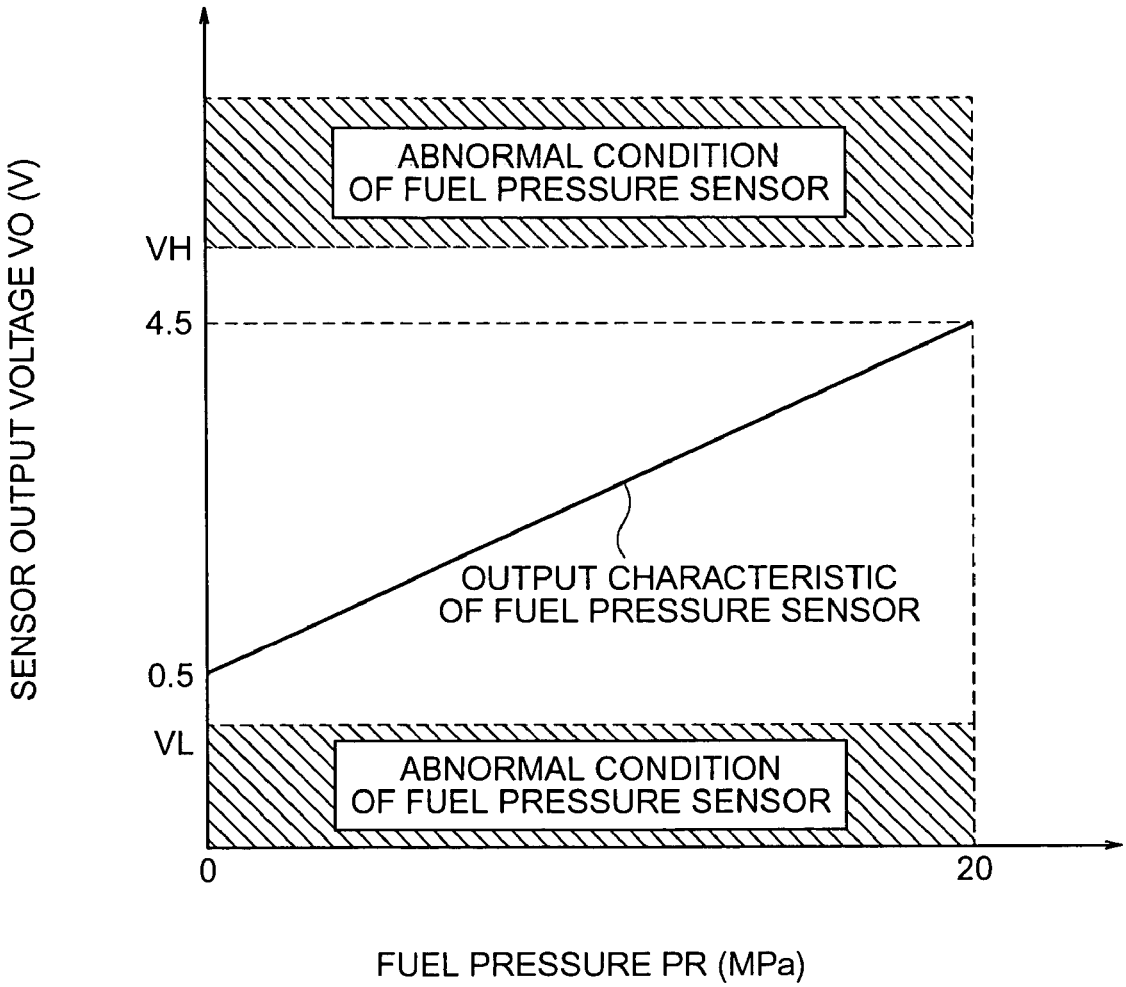
FIG. 3 is an explanatory graph showing the output characteristic of a fuel pressure sensor in FIGS. 1 and 2.

FIG. 3 is an explanatory graph showing the output characteristic of the fuel pressure sensor 61. The horizontal axis shows a fuel pressure PR (MPa) in the pressure accumulation chamber 50, and the vertical axis indicates the output voltage VO (V) of the electrical signal outputted from the fuel pressure sensor 61 in correspondence with the fuel pressure PR.

In FIG. 3, the fuel pressure sensor 61 generates an output voltage VO (=0.5 V to 4.5 V) in correspondence with the fuel pressure PR (=0 MPa to 20 MPa).

When the output voltage VO of the fuel pressure sensor 61 deviates from the normal range (=0.5 V to 4.5 V), i.e., the fuel pressure sensor 61 indicates a voltage value higher than the upper limit value VH or indicates a voltage value lower than the lower limit value VL, it is determined that the fuel pressure sensor 61 is in the abnormal condition.

The drive pulse width calculation means 106 in the ECU 60 obtains the output voltage VO of the fuel pressure sensor 61 after A/D conversion of the output voltage VO. Then, the drive pulse width calculation means 106 corrects the drive pulse width PW of the fuel injection valve 51 based on the fuel pressure PR converted in accordance with the output characteristic in FIG. 3, and drives the fuel injection valve 51 for injecting a predetermined amount of the fuel to each of cylinders.

Next, control operation according to the first embodiment of the present invention will be described with reference to a flow chart in FIG. 4.

The air-fuel ratio sensor 68 includes a lambda air-fuel ratio sensor. If the actual air-fuel ratio AFr is lean with respect to the theoretical air-fuel ratio (=14.7), the air-fuel ratio sensor 68 outputs an H(high)-level signal. If the actual air-fuel ratio AFr is rich with respect to the theoretical air-fuel ratio, the air-fuel ratio sensor 68 outputs an L(low)-level signal.

Further, the ECU 60 is programmed to perform feedback control of the actual air-fuel ratio AFr. When a failure occurs in at least the fuel pressure sensor 61, the ECU 60 performs the feedback control such that the actual air-fuel ratio AFr matches the theoretical air-fuel ratio.

Figure 4:
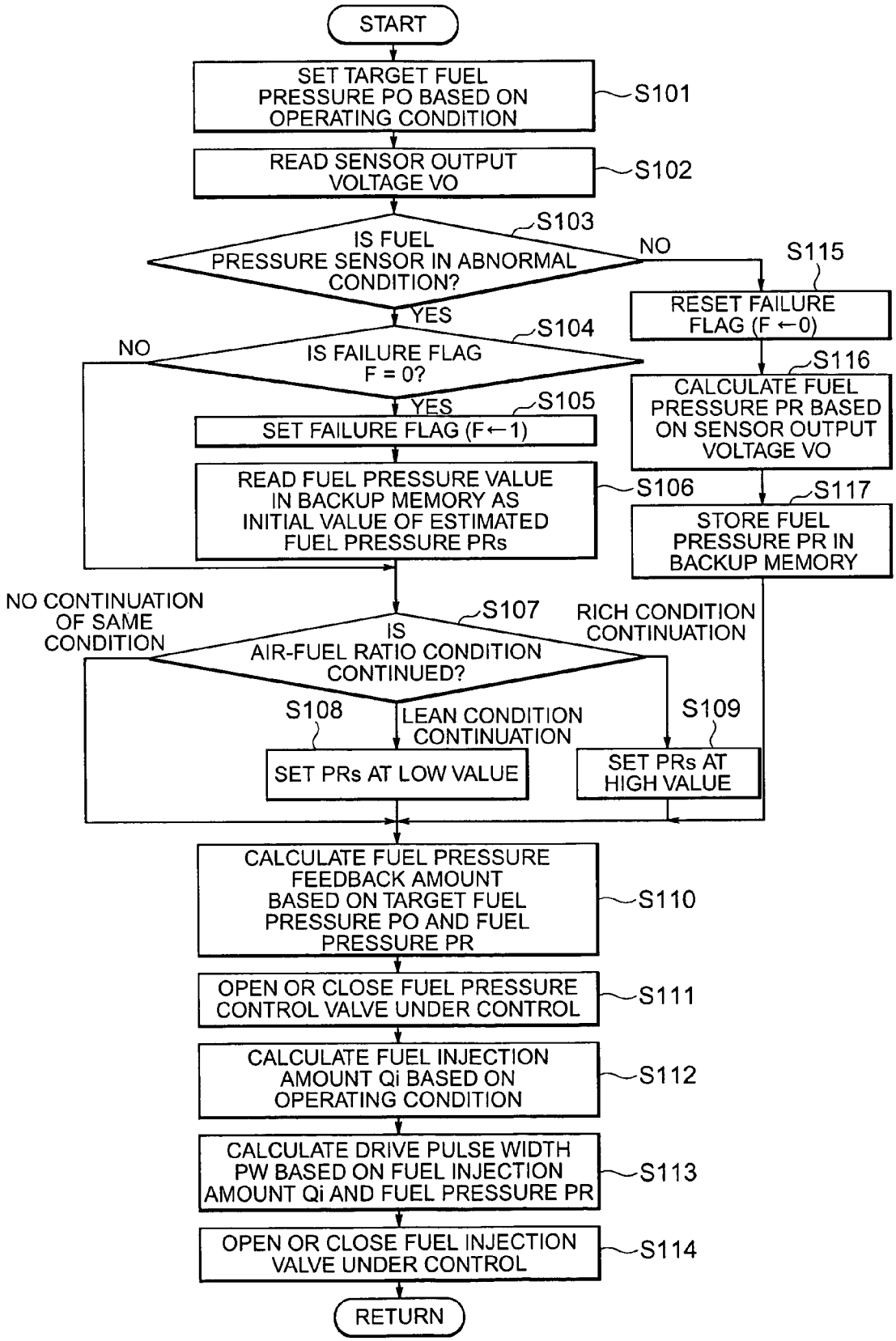
FIG. 4 is a flow chart showing control operation according to the first embodiment of the present invention.

In FIG. 4, firstly, the fuel pressure control means 102 in the ECU 60 sets a target fuel pressure PO based on operating condition information such as detection information (revolution number of the engine 40) from the rotational speed sensor 62 and detection information (actual depression amount of the accelerator pedal 63) from the accelerator position sensor 64 (step S101).

Further, the ECU 60 reads the output voltage VO (corresponding to the actual fuel pressure PR) of the fuel pressure sensor 61 (step S102).

Then, the abnormality diagnosis means 101 determines whether the fuel pressure sensor 61 is in the abnormal condition or not based on information as to whether the output voltage VO of the fuel pressure sensor 61 read in step S102 indicates an abnormal value or not (step S103).

At this time, since there is a relationship between the output voltage VO from the fuel pressure sensor 61 and the fuel pressure PR as shown by the output characteristic in FIG. 3, if the sensor output voltage VO is in a normal range (VL<VO<VH), the fuel pressure sensor 61 is diagnosed as functioning normally.

If the sensor output voltage VO is not less than the upper limit voltage VH (VO≧VH), or not greater than the lower limit voltage VL (VO≦VL), since the sensor output voltage is the abnormal value which can not be observed in a normal condition, the fuel pressure sensor 61 is diagnosed as having a failure (in the abnormal condition).

In step S103, if it is determined that the sensor output voltage VO has a normal value (VL<VO<VH) (i.e., NO) and the fuel pressure sensor 61 is diagnosed as normal, a failure flag F of the pressure sensor 61 is reset (F=0) (step S115).

Then, the output voltage VO of the fuel pressure sensor 61 is converted into the fuel pressure PR based on the output characteristic in FIG. 3 (step S116), and the fuel pressure PR is stored in a backup memory of the ECU 60 (step S117). Then, the routine proceeds for performing the fuel pressure feedback control (steps S110 and S111), and the fuel injection control (steps S112 to S114).

In the fuel pressure feedback control process, a feedback amount for controlling the fuel pressure control valve 10 is calculated based on the target fuel pressure PO set in step S101 and the fuel pressure PR converted in step S116. In accordance with the feedback control amount, the fuel pressure control valve 10 is opened or closed under control (step S111).

In the fuel injection control process, the fuel injection amount Qi as the amount of the fuel injected from the fuel injection valve 51 is calculated based on the operating condition of the engine 40 (step S112). The drive pulse width PW of the fuel injection valve 51 is calculated based on the fuel injection amount Qi and the fuel pressure PR converted in step S116 (step S113), and the fuel injection valve 51 is opened or closed under control (step S114). Then, the processing routine in FIG. 4 is finished.

For example, the drive pulse width per unit injection amount and the invalid time of the fuel injection valve 51 corresponding to each fuel pressure value are stored in a memory of the ECU 60 in advance. Therefore, in step S113, the drive pulse width PW can be calculated based on the fuel pressure PR and the fuel injection amount Qi.

In step S103, if it is determined that the sensor output voltage VO has an abnormal value (VO≧VH or VO≦VL) (i.e., YES) and the fuel pressure sensor 61 is diagnosed as being in the abnormal condition, then it is determined whether the failure flag F of the fuel pressure sensor 61 has not been set (F=0) (step S104).

In step S104, if it is determined that the failure flag F has been set, F=1, (i.e., NO), the routine immediately proceeds to the next determination process (step S107).

In step S104, if it is determined that the fuel pressure sensor 61 has been functioning normally until the occurrence of the abnormal condition at this time, and the failure flag F has not been set, F=0 (i.e., YES), the failure flag F is set, F=1 (step S105).

Then, the fuel pressure estimation means 103 reads the fuel pressure value for the normal condition, which was stored in the backup memory when the fuel pressure sensor 61 was in the normal condition in step S117, again as the fuel pressure PR (step S106), and the routine proceeds to the next determination process (step S107).

That is, if the fuel pressure sensor 61 is diagnosed as being in the abnormal condition, in step S106, the fuel pressure value which was detected immediately before the abnormality diagnosis (the fuel pressure PR stored in the backup memory) is set as an initial value of the estimated fuel pressure PRs.

Then, in step S107, the present air-fuel ratio condition (continuation condition) is determined.

That is, it is determined whether the air-fuel ratio condition detected by the air-fuel ratio sensor 68 is a lean continuation condition (the lean condition has continued for a predetermined time) or a rich continuation condition (the rich condition has continued for a predetermined time), or no continuation condition of the same condition (neither the lean condition nor the rich condition has continued for a predetermined time).

In step S107, if it is determined that the air-fuel ratio is in the "lean continuation condition", a predetermined value is subtracted from the estimation fuel pressure PRs for correction (step S108), and if determined that the air-fuel ratio is in the "rich continuation condition", a predetermined value is added to the estimated fuel pressure PRs for correction (step S109), and then the routine proceeds to a fuel pressure feedback control process (step S110).

If it is determined that the air-fuel ratio is in the "no continuation condition of the same condition", the correction process of the estimated fuel pressure PRs (step S108 or S109) is not carried out. Then, the routine proceeds to step S110.

The estimated fuel pressure PRs is handled as the fuel pressure PR in the following control processes (steps S110 to S114).

That is, in step S110, the fuel pressure feedback control amount of the fuel pressure control valve 10 is calculated based on the estimated fuel pressure PRs (=fuel pressure PR) corrected in step S108 or S109, and the target fuel pressure PO set in step S101.

Likewise, in step S113, the drive pulse width PW of the fuel injection valve 51 is calculated based on the estimated fuel pressure PRs (=fuel pressure PR) corrected in step S108 or S109, and the fuel injection amount Qi set in step S112.

Thus, if the fuel pressure sensor 61 is diagnosed as being in the abnormal condition, the estimated fuel pressure PRs in the pressure accumulation chamber 50 is calculated based on the air-fuel ratio condition, and the estimated fuel pressure PRs is corrected such that the air-fuel condition is guided to the target air-fuel ratio AFo. Therefore, the highly accurate drive pulse width PW is used as the fuel pressure PR in the control. The drive pulse width PW of the fuel injection valve 51 is corrected appropriately. Thus, it is possible to achieve the reliable safe mode operation without causing any accidental fire or engine stop.

Further, when the air-fuel ratio condition detected by the air-fuel ratio sensor 68 (lambda air-fuel ratio sensor) is the condition where the lean condition or the rich condition has continued for a predetermined time or more, the correction process of the estimated fuel pressure PRs is carried out. Therefore, even in the device employing the inexpensive lambda air-fuel ratio sensor, it is possible to calculate the estimated fuel pressure PRs with high accuracy.

Also, if the fuel pressure sensor 61 is diagnosed as being in the abnormal condition, the fuel pressure detected by the fuel pressure sensor 61 immediately before the abnormality diagnosis is used as the initial value of the estimated fuel pressure PRs. Therefore, the estimated fuel pressure PRs can be calculated immediately after the occurrence of the abnormal condition with high accuracy for controlling the fuel pressure control valve 10 and the fuel injection valve 51.

Furthermore, if the fuel pressure sensor 61 is diagnosed as being in the abnormal condition, the estimated fuel pressure PRs is set. Therefore, it is possible to carry out the feedback control of the fuel pressure control valve 10 such that the target fuel pressure PO in correspondence with the operating condition is achieved. Thus, the safe mode operation is carried out in a wide operation range.

Second Embodiment

In the first embodiment, the lambda air-fuel ratio sensor is used as the air-fuel ratio sensor 68. Alternatively, a linear air-fuel ratio sensor which is capable of detecting a value of the actual air-fuel ratio AFr as a physical amount may be used.

Next, control operation in a second embodiment of the present invention using the linear air-fuel ratio sensor as the air-fuel ratio sensor 68 will be described with reference to FIGS. 1 and 2 and a flow chart in FIG. 5.

Figure 5:
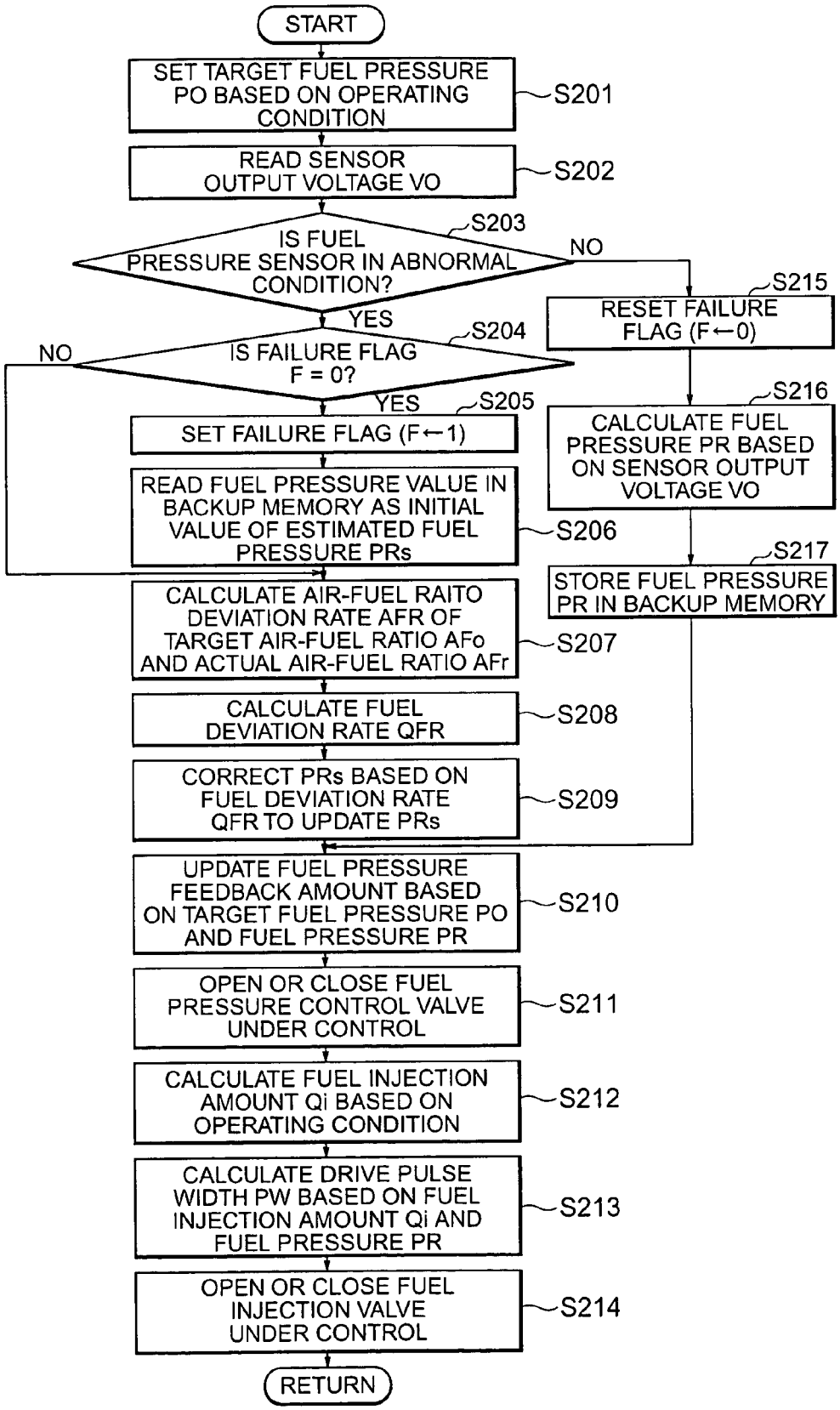
FIG. 5 is a flow chart showing control operation according to a second embodiment of the present invention.

In FIG. 5, processes in steps S201 to S206, and S210 to S217 are similar to the above-mentioned processes in steps S101 to S106, and S110 to S117 (see FIG. 4).

FIG. 5 is different from FIG. 4 in that processes in steps in S207 to S209 are carried out instead of the above-mentioned processes in steps S107 to S109.

Therefore, the processes in steps S201 to S206, and S210 to S217 are carried out in the same manner as described above, and detailed description thereof is omitted.

In this case, the air-fuel ratio condition detected by the air-fuel ratio sensor 68 indicates a physical amount of the actual air-fuel ratio AFr. The fuel pressure estimation means 103 carries out a correction process of the estimated fuel pressure PRs in correspondence with the air-fuel ratio AFr (physical amount).

In FIG. 5, firstly, the target fuel pressure PO is set based on the operating condition information (step S201), and the sensor output pressure VO is read (step S202). Further, it is determined whether the fuel pressure sensor 61 is in the abnormal condition or not (step S203).

In step S203, if the fuel pressure sensor 61 is not in the abnormal condition (in the normal condition) (i.e., NO), the failure flag F is cleared, i.e., 0 is set to F (step S215), the fuel pressure PR is calculated based on the sensor output voltage VO (step S216), and the fuel pressure PR is stored in the backup memory of the ECU 60 (S217). Then, the routine proceeds to control processes in steps S210 to S214.

In step S203, if it is determined that the fuel pressure sensor 61 is in the abnormal condition (i.e., YES), subsequently, it is determined whether the failure flag F has not been set (F=0) (step S204). If it is determined that the failure flag F has been set (F=1) (i.e., NO), the routine immediately proceeds to step S207.

Further, in step S204, if it is determined that the failure flag F has been set (F=0) (i.e., YES), the failure flag F is set (F=1) (step S205), and the fuel pressure value at the time of normal condition stored in the backup memory is read again to set as the estimated fuel pressure PRs (step S206). Then, the routine proceeds to step S207.

In step S207, the "air-fuel ratio deviation rate AFR" based on the target air-fuel ratio AFo and the actual air-fuel ratio AFr detected by the air-fuel ratio sensor 68 is calculated by the following equation (1).

$$AFR=AFo/AFr \quad (1)$$

In the equation (1), if AFR=1 (the target air-fuel ratio AFo matches the actual air-fuel ratio AFr), it is considered that the actual fuel pressure PR matches the estimated fuel pressure PRs.

If AFR<1, (the actual air-ratio AFr is in a lean condition with respect to the target air-fuel ratio AFo), it is considered that the drive pulse width PW of the fuel injection valve 51 is erroneously corrected by the estimated pressure PRs which is higher than the actual fuel pressure PR.

Conversely, if AFR>1, (the actual air-ratio AFr is in a rich condition with respect to the target air-fuel ratio AFo), it is considered that the drive pulse width PW of the fuel injection valve 51 is erroneously corrected by the estimated pressure PRs which is lower than the actual fuel pressure PR.

Therefore, next, based on the air-fuel ratio deviation rate AFR calculated by the equation (1) (step S207), the fuel deviation rate QFR is calculated by the following equation (2) (step S208).

$$QFR=1/AFR \tag{2}$$

As can be seen from the equation (2), in order to match the actual air-fuel ratio AFr with the target air-fuel ratio AFo, it is necessary to multiply the fuel injection amount Qi by the "fuel deviation rate QFR".

Subsequently, the estimated fuel pressure PRs is corrected based on the fuel deviation rate QFR calculated by the above equation (2) for updating the estimated fuel pressure PRs (step S209). Then, the routine proceeds to the above-mentioned control processes (steps S210 to S214).

Next, the process in step S209 will be described below more specifically.

Now, theoretically, the relationship represented by the following equation (3) exists between the present estimated fuel pressure PRs and the estimated fuel pressure PX which achieves the present fuel injection amount Qi to be multiplied by the fuel deviation rate QFR.

$$\sqrt{(PR/PX)}=QFR \tag{3}$$

Further, as a specific example, if the detected value "16.3" of the actual air-fuel ratio AFr is a lean condition with respect to the target air-fuel ratio AFo (=14.7), the equation (1) can be expressed by the following equation (4).

$$\begin{aligned} AFR &= AFo/AFr \\ &= 14.7/16.3 \\ &= 0.9 \end{aligned} \tag{4}$$

As can be seen from the equation (4), the present air-fuel ratio AFr is in a lean condition with respect to the target fuel-air ratio AFo by "about 10%".

Further, at this time, the equation (2) can be expressed by the following equation (5).

$$\begin{aligned} QFR &= 1/AFR \\ &= 1/0.9 \\ &= 1.11 \end{aligned} \tag{5}$$

As can be seen from the equation (5), it is necessary to multiply the present fuel injection amount Q1 by "1.11" for correction to match the actual air-fuel ratio AFr with the target air fuel ratio AFo.

Further, the equation (3) is expressed by the following equation (6) using the value of the equation (5) and the present estimated fuel pressure PRs (=10 [MPa]).

$$\sqrt{(10/PX)}=1.11 \tag{6}$$

Thus, from the equation (6), the value of the estimated fuel pressure PX which achieves the present fuel injection amount Qi to be multiplied by the fuel deviation rate QFR is "8.1 [MPa]". Therefore, it is proven that the estimated fuel pressure PRs corresponding to the real actual fuel pressure PRs estimated based on the air-fuel ratio condition is "8.1 [MPa]".

Based on the result, in step S209, the present estimated fuel pressure PRs (=10 [MPa]) is corrected (updated) to the new estimated fuel pressure PX (=8.1 [MPa]).

The method of calculating the estimated fuel pressure PRs based on the air-fuel ratio condition is not limited to the above example. For example, the drive pulse width per unit injection amount and the invalid time of the fuel injection valve 51 corresponding to each fuel pressure value may be stored in the memory of the ECU 60. Based on the stored information, the estimated fuel pressure PRs can be calculated strictly using a map.

Next, in the same manner as described above, the control processes in steps S210 to S214 are carried out by handling the estimated fuel pressure PRs as the fuel pressure PR.

That is, in step S210, the feedback control amount of the fuel pressure control valve 10 is calculated based on the target fuel pressure PO set in step S201 and the new estimated fuel pressure PRs (=PX) corrected (updated) in step S209.

Likewise, in step S213, the drive pulse width PW of the fuel injection valve 51 is calculated based on the fuel injection amount Qi calculated in step S212 and the new estimated fuel pressure PRs (=PX) corrected (updated) in step S209.

Thus, by carrying out the correction process of the estimated fuel pressure PRs in correspondence with the detection value (actual air-fuel ratio AFr) from the air-fuel ratio sensor 68 including the linear air-fuel ratio sensor, it is possible to calculate the estimated fuel pressure PRs with extremely high accuracy at high speed.

Third Embodiment

In the first and second embodiments, the fuel pressure control means 102 sets the common target fuel pressure PO regardless of whether the fuel pressure sensor 61 is in the abnormal condition or not. However, if the fuel pressure sensor 61 is diagnosed as being in the abnormal condition, the target fuel pressure PO may be switched to the abnormal condition target fuel pressure used in the abnormal condition which is different from the normal target fuel pressure PO.

Next, control operation in a third embodiment of the present invention will be described with reference to FIGS. 1 and 2, and a flow chart in FIG. 6. In the third embodiment, the switching operation to the abnormal condition target fuel pressure is carried out.

Figure 6:
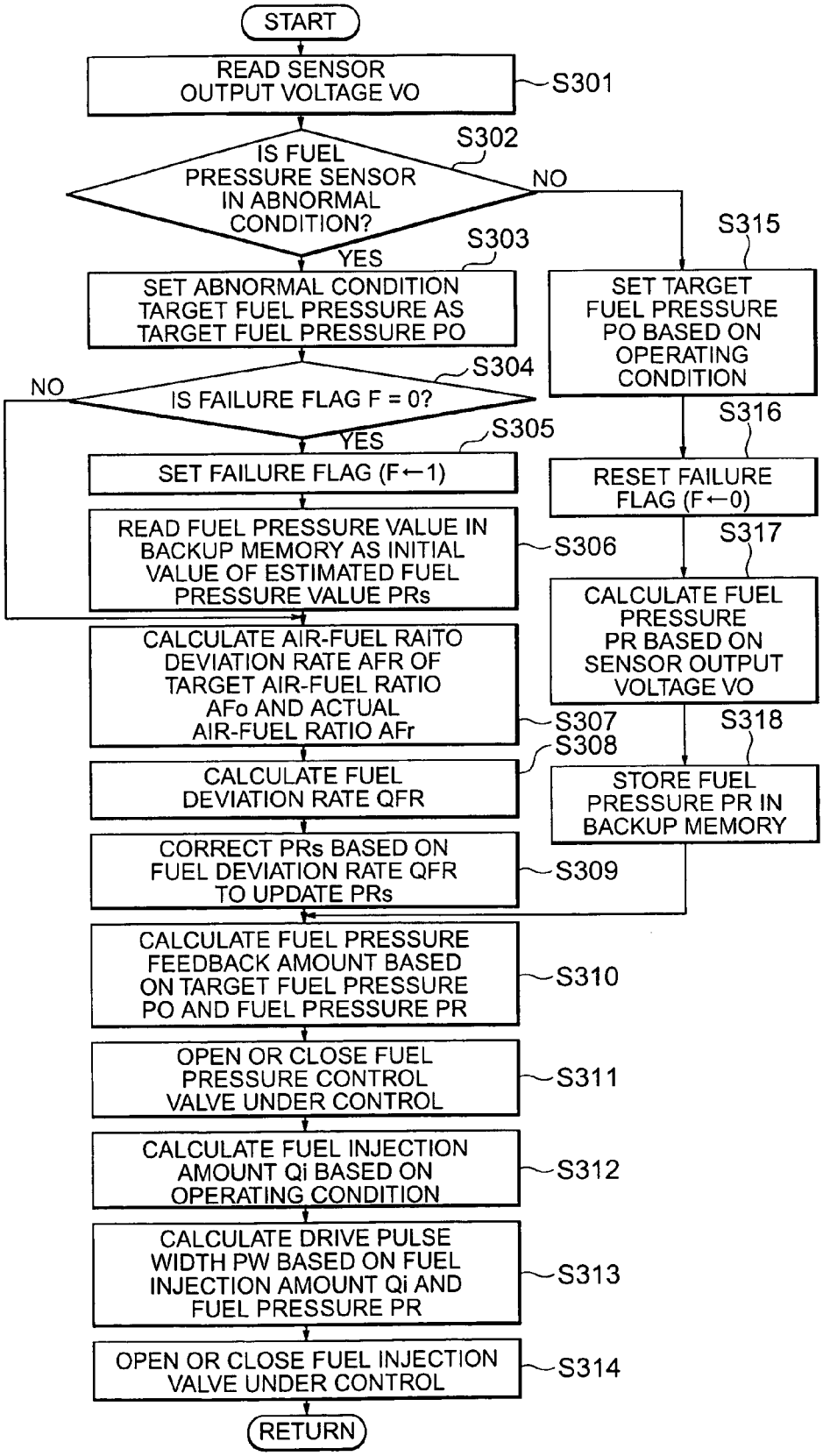
FIG. 6 is a flow chart showing control operation according to a third embodiment of the present invention.

In FIG. 6, processes in steps S315, S301, S302, S304 to S314, and S316 to S318 are similar to the above-mentioned processes in steps S201 to S217 (see FIG. 5).

FIG. 6 differs from FIG. 5 only in that the setting process of the target fuel pressure PO (step S315) is carried out after the determination of the normal condition of the fuel pressure sensor 61, and the setting process of the abnormal condition target fuel pressure (step S303) is carried out after the determination of the abnormal condition of the fuel pressure sensor 61.

Therefore, the processes in steps S301, S302, S304 to S318 are carried out as described above, and detailed description thereof is omitted.

In this case, when the fuel pressure sensor 61 is diagnosed as being in the abnormal condition, the fuel pressure control means 102 in the ECU 60 switches the target fuel pressure PO to the abnormal condition target fuel pressure which is different from the target fuel pressure PO used in the normal condition, and performs the feedback control of the fuel pressure control valve 10 such that the estimated fuel pressure PRs matches the abnormal condition target fuel pressure.

Further, the fuel pressure control means 102 sets the target fuel pressure PO immediately before the fuel pressure sensor 61 is diagnosed as being in the abnormal condition as the abnormal condition target fuel pressure. Alternatively, when the fuel pressure sensor 61 is diagnosed as being in the abnormal condition, the fuel pressure control means 102 sets the fuel pressure value of the high pressure side as the abnormal condition target fuel pressure, excluding at least one of the maximum fuel pressure and the minimum fuel pressure of the pressure accumulation chamber 50.

In FIG. 6, firstly, the sensor output voltage VO is read (step S301), and it is determined whether the fuel pressure sensor 61 is in the abnormal condition or not (step S302). If it is determined that the fuel pressure sensor 61 is functioning normally, (i.e., NO), the target fuel pressure PO is set based on the operating condition (step S315), the failure flag F is reset (step S316), the fuel pressure PR is converted (step S317), and the fuel pressure PO is stored (step S318). Then, the routine proceeds to perform the control processes (steps S310 to S314).

In step S302, if it is determined that the fuel pressure sensor 61 is in the abnormal condition (i.e., YES), the abnormal condition target fuel pressure is set as the target fuel pressure PO (step S303). Then, the routine proceeds to perform the determination process of the failure flag F (step S304).

At this time, the fuel pressure PR (the normal value immediately before occurrence of the abnormal condition) stored in the backup memory in step S318 is set as the abnormal condition target fuel pressure, or the high pressure fuel pressure value excluding the maximum pressure (valve opening pressure of the relief valve 37) or the minimum pressure (adjustment pressure of the low pressure regulator 33) is set.

Then, in step S304, if it is determined that F=1, (i.e., NO), the routine proceeds to the calculation process of the air-fuel ratio deviation rate AFR (step S307). In step S304, if it is determined that F=0, (i.e., YES), the failure flag F is set (step S305), the initial value of the estimated fuel pressure PRs is read (step S306). Then, the routine proceeds to step S307.

In steps S307 to S309, the estimated fuel pressure PRs is updated in the same manner as described above. Then, the routine proceeds to step S310.

Next, in steps S310 to S314, the abnormal condition target fuel pressure set in step S303 and the new estimated fuel pressure PRs corrected (updated) in step S309 are handled as the target fuel pressure PO and the fuel pressure PR for carrying out the control process of the fuel pressure control valve 10 and the fuel injection valve 51.

As described above, if the fuel pressure sensor 61 is diagnosed as being in the abnormal condition, setting of the target fuel pressure is switched to the abnormal condition target fuel pressure which is different from the target fuel pressure PO used in the normal condition, and the feedback control of the fuel pressure control valve 10 is performed such that the estimated fuel pressure PRs matches the abnormal condition target fuel pressure for reducing the deviation amount (difference) between the estimated fuel pressure PRs and the actual fuel pressure PR.

Further, if the fuel pressure sensor 61 is diagnosed as being in the abnormal condition, the target fuel pressure PO in correspondence with the operating condition immediately before the fuel pressure sensor 61 is diagnosed as being in the abnormal condition is set as the abnormal condition target fuel pressure. Thus, the deviation amount between the estimated fuel pressure PRs and the actual fuel pressure PR is reduced, and the estimated fuel pressure PRs is calculated highly accurately at high speed.

Furthermore, if the fuel pressure sensor 61 is diagnosed as being in the abnormal condition, the high pressure fuel value excluding at least one of the maximum pressure and the minimum pressure of the pressure accumulation chamber 50 is set as the abnormal condition target fuel pressure to reduce the deviation amount between the estimated fuel pressure PRs and the actual fuel pressure PR. Thus, the safe mode operation is carried out in a wide operation range.

Fourth Embodiment

When the fuel pressure sensor 61 is diagnosed as being in the abnormal condition, the detection value of the depression amount of the accelerator pedal 63 is filtered, and the position of the electronically controlled throttle valve 66 may be controlled in correspondence with the detection value after the filtering process, although no description is given particularly in this regard in the above first to third embodiments.

Next, processing operation according to a fourth embodiment will be described with reference to FIGS. 1 and 2 and a flow chart in FIG. 7. In the fourth embodiment, the filtering process to the detection value of the depression amount of the accelerator pedal 63 is carried out when the abnormal condition of the fuel pressure sensor 61 occurs.

Figure 7:
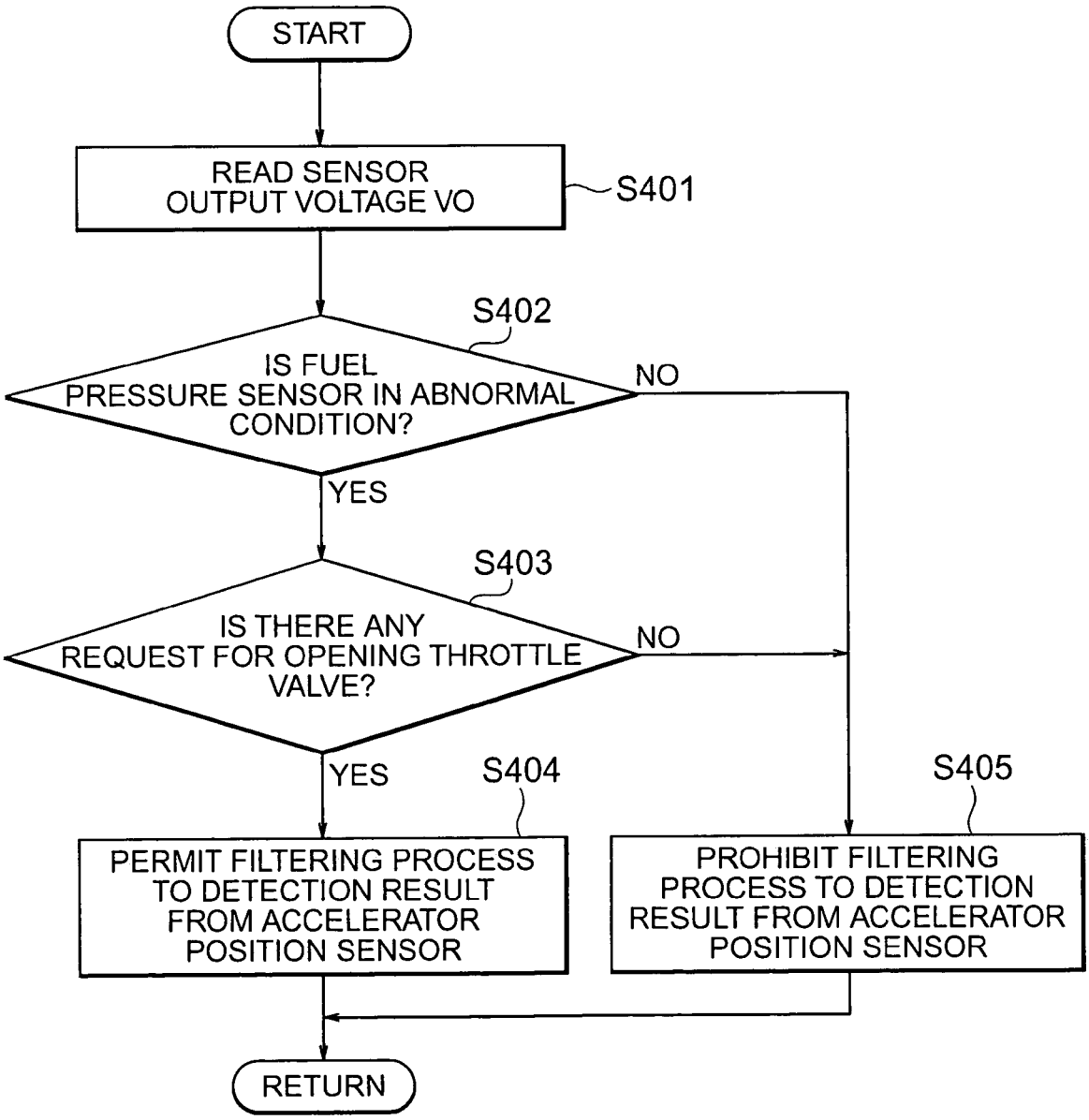
FIG. 7 is a flow chart showing control operation according to a fourth embodiment of the present invention.

In FIG. 7, processes in steps S401 and S402 are similar to the above-mentioned processes in steps S301 and S302, respectively (see FIG. 6).

FIG. 7 shows the process to be carried out in response to the detection result from the accelerator position sensor 64, depending on whether the fuel pressure sensor 61 is in the abnormal condition or not.

In this case, the throttle position control means 105 in the ECU 60 controls the position of throttle valve 66 for adjusting the intake amount of the air supplied to a combustion chamber in correspondence with the detection value of the accelerator position sensor 64 (depression amount of the accelerator pedal 63). If the fuel pressure sensor 61 is diagnosed as being in the abnormal condition, the detection amount of the depression amount of the accelerator pedal 63 is filtered, and the position of the throttle valve 66 is controlled in correspondence with the filtered detection value.

The throttle position control valve 105 controls the position of the throttle valve 66 in correspondence with the filtered detection value, only if the depression amount of the accelerator pedal 63 is in the opening direction of the throttle valve 66.

In FIG. 7, firstly, the sensor output voltage VO is read (step S401), then, it is determined whether the fuel pressure sensor 61 is in the abnormal condition or not (step S402).

In step S402, if it is determined the fuel pressure sensor is in the abnormal condition (i.e., NO), then, the "filtering process" to the detection result from the accelerator position sensor 64 (depression amount of the accelerator pedal 63) is prohibited (step S405), and the processing routine in FIG. 7 is finished.

In step S402, if it is determined that the fuel pressure sensor 61 is in the abnormal condition (i.e., YES), then, it is determined whether the request regarding the position of the throttle valve 66 determined based on the detection result from the accelerator position sensor 64 indicates the request for adjusting the position the throttle valve 66 in the opening direction from the present position of the throttle valve 66 (step S403).

In step S403, if there is no request for opening the throttle valve 66 (i.e., NO), the routine proceeds to step S405. If there is any opening request of the throttle valve 66 (i.e., YES), the "filtering process" to the detection result from the accelerator position sensor 64 is permitted (step S404), and the processing routine in FIG. 7 is finished.

Then, the position of the throttle valve 66 is controlled based on the permission or prohibition of the "filtering process" in step S404 or S405.

Here, supplemental description regarding operation at the time of failure of the fuel pressure sensor 61 will be given with reference to a timing chart in FIG. 8.

Figure 8:
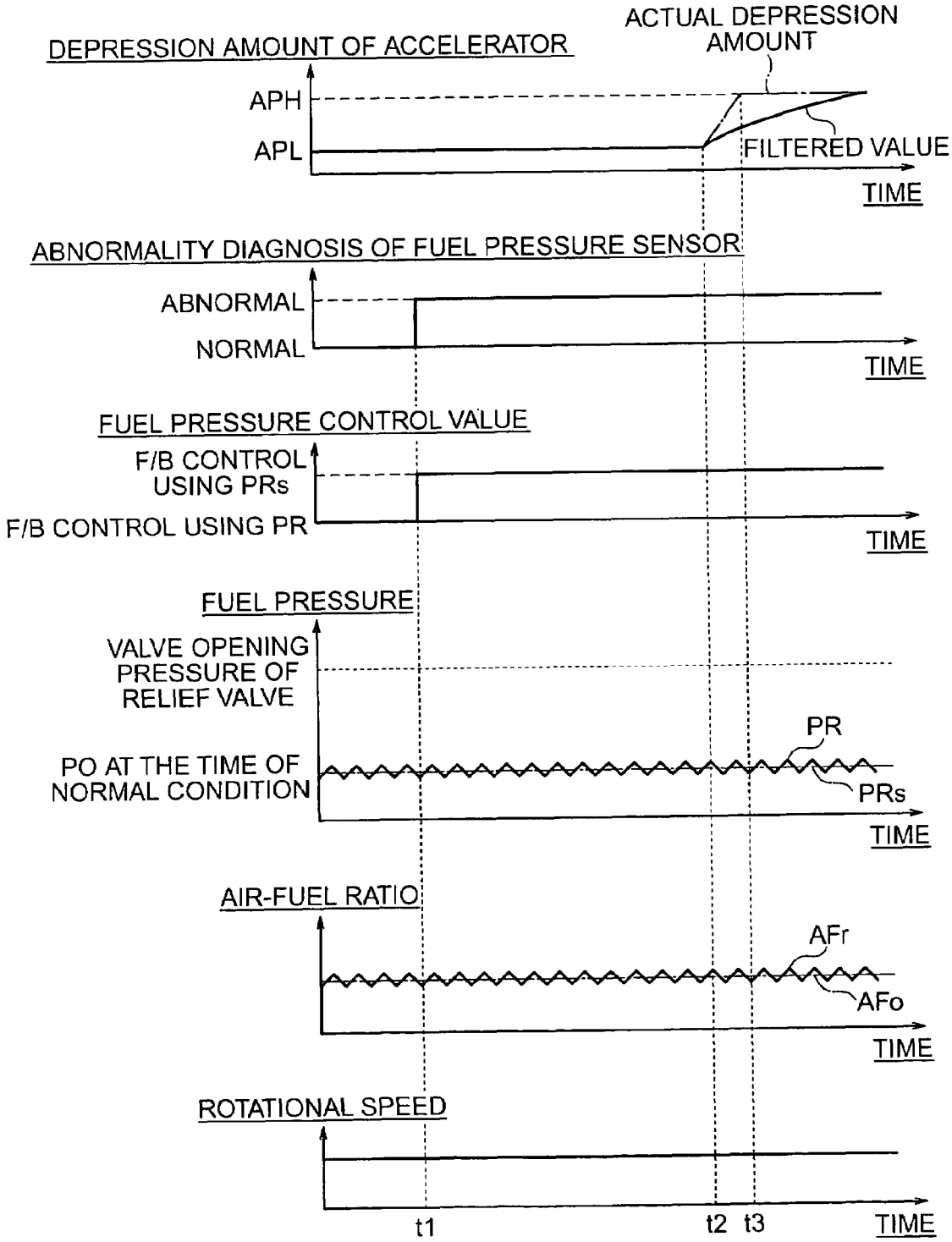
FIG. 8 is a timing chart for explanation of the control operation according to the fourth embodiment of the present invention.

In FIG. 8, the horizontal axis indicates time including a time t1 when the abnormal condition of the fuel pressure sensor 61 occurs, and a time t2 when depression of the accelerator pedal 63 is started, and a time t3 when depression of the accelerator pedal 63 is finished.

FIG. 8 shows correlation of the accelerator depression amount (the upper limit value APH to the lower limit value APL), the abnormality diagnosis result from the fuel pressure sensor 61 corresponding to the failure flag F (abnormal "H", normal "L"), the control condition of the fuel pressure control valve 10 (feedback control based on the estimated fuel pressure PRs and feedback control based on the fuel pressure PR), fluctuation of the fuel pressure PR over time around the estimated fuel pressure PRs (chain line), and fluctuation of the air-fuel ratio AFr around the target air-fuel ratio AFo, and the rotational speed of the engine 40.

In FIG. 8, the fuel pressure sensor 61 is diagnosed as functioning normally (F=0) until the time t1. The feedback control is performed such that the actual fuel pressure PR in the pressure accumulation chamber 50 matches the target fuel pressure PO used in the normal condition.

Therefore, the actual fuel ratio AFr matches the target air-fuel ratio AFo.

Then, when the abnormal condition of the fuel pressure sensor 61 occurs at the time t1, the abnormality diagnosis means 101 determines that the fuel pressure sensor 61 is in the abnormal condition, and the fuel pressure estimation means 103 calculates the fuel pressure value immediately before occurrence of the abnormal condition of the fuel pressure sensor 61 as the estimated fuel pressure PRs, and further the fuel pressure control means 102 continues to perform the feedback control of the fuel pressure such that the estimated fuel pressure PRs matches the target fuel pressure PO.

As a result, after the time t1 when the failure of the pressure sensor 61 occurs, the fuel pressure PRs is continuously estimated with high accuracy, and the drive pulse width PW of the fuel injection valve 51 is corrected appropriately. Therefore, the air-fuel ratio AFr does not deviate from the target air-fuel ratio AFo, and the reliable safe mode operation is continued.

In the time t2 in the middle of safe mode operation, when the accelerator pedal 63 is depressed suddenly to a large extent, in response to the actual acceleration depression amount (see chain line in FIG. 8), the value of the depression amount (see solid line) after the "filtering process" is used. Therefore, the fuel injection amount is not increased abruptly, but increased gradually under control.

Since the abrupt change of the load on the engine 40 is avoided, the actual fuel pressure PR which has been maintained at the target fuel pressure PO is continued to be stably controlled after the time t3.

As described above, when the fuel pressure sensor 61 is diagnosed as being in the abnormal condition, the position of the throttle valve 66 is controlled based on the value obtained by correcting the detection result from the accelerator position sensor 64 by the "filtering process". Therefore, even if there is a request for the transitional change of the load, the change in the position of the throttle valve 66 is made gradually. Thus, the deviation amount between the estimated fuel pressure PRs and the actual fuel pressure PR is reduced.

Further, when the fuel pressure sensor 61 is diagnosed as being in the abnormal condition, the position of the throttle valve 66 is adjusted in correspondence with the value after the "filtering process" only in response to the operation of the accelerator pedal 63 in the opening direction of the throttle valve 66. Therefore, even if there is a request for transitional increase of the load, the change of the throttle valve 66 is gradually performed. Thus, it is possible to reduce the deviation amount between the estimated fuel pressure PRs and the actual fuel pressure PR, and achieve the quick response to the deceleration request.

What is claimed is:

1. A fuel pressure control device for an internal combustion engine, comprising:

a fuel injection valve for injecting a fuel directly into a combustion chamber of the internal combustion engine;

a pressure accumulation chamber connected to the fuel injection valve for storing a high pressure fuel;

a high pressure pump for pressurizing a low pressure fuel supplied from a fuel tank in a pressure chamber, and supplying the high pressure fuel to the pressure accumulation chamber;

a fuel pressure control valve for controlling at least one of an amount of the fuel discharged from the high pressure pump to the pressure accumulation chamber and a fuel pressure in the pressure accumulation chamber;

a fuel pressure sensor for detecting the fuel pressure in the pressure accumulation chamber;

an air-fuel ratio sensor for detecting an air-fuel ratio condition in the internal combustion engine;

target value calculation means for calculating a target fuel pressure and a target air-fuel ratio based on an operating condition of the internal combustion engine;

fuel pressure control means for performing feedback control of the fuel pressure control valve such that the fuel pressure detected by the fuel pressure sensor matches the target fuel pressure;

abnormality diagnosis means for diagnosing whether the fuel pressure sensor is in an abnormal condition or not; and fuel pressure estimation means for calculating an estimated pressure in the pressure accumulation chamber based on the air-fuel ratio condition when the abnormality diagnosis means diagnoses that the fuel pressure sensor is in the abnormal condition, wherein the fuel pressure estimation means corrects the estimated fuel pressure such that the air-fuel ratio condition is guided to the target air-fuel ratio.

2. A fuel pressure control device for an internal combustion engine according to claim 1, wherein:

the air-fuel ratio sensor comprises a lambda air-fuel ratio sensor;

the air-fuel ratio condition detected by the air-fuel ratio sensor indicates one of a lean condition and a rich condition with respect to a theoretical air-fuel ratio; and the fuel pressure estimation means carries out a correction process of the estimated fuel pressure when the air-fuel ratio condition continues to indicate one of the lean condition and the rich condition for a predetermined period of time or more.

3. A fuel pressure control device for an internal combustion engine according to claim 1, wherein:

the air-fuel ratio sensor comprises a linear air-fuel ratio sensor;

the air-fuel ratio condition detected by the air-fuel ratio sensor indicates a physical amount of the air-fuel ratio; and the fuel pressure estimation means carries out the correction process of the estimated fuel pressure based on the physical amount of the air-fuel ratio.

4. A fuel pressure control device for an internal combustion engine according to claim 1, wherein the fuel pressure estimation means sets the fuel pressure in the pressure accumulation chamber, which was detected immediately before the fuel pressure sensor is diagnosed as being in the abnormal condition, as an initial value of the estimated fuel pressure.

5. A fuel pressure control device for an internal combustion engine according to claim 1, wherein the fuel pressure control means performs feedback control of the fuel pressure control valve such that the estimated fuel pressure matches the target fuel pressure when the fuel pressure is diagnosed as being in the abnormal condition.

6. A fuel pressure control device for an internal combustion engine according to claim 1, wherein the fuel pressure control means switches the target fuel pressure to an abnormal condition target fuel pressure, and performs feedback control of the fuel pressure control valve such that the estimated fuel pressure matches the abnormal condition target fuel pressure when the fuel pressure sensor is diagnosed as being in the abnormal condition.

7. A fuel pressure control device for an internal combustion engine according to claim 6, wherein the fuel pressure control means sets the target fuel pressure immediately before the fuel pressure sensor is diagnosed as being in the abnormal condition as the abnormal condition target fuel pressure.

8. A fuel pressure control device for an internal combustion engine according to claim 6, wherein the fuel pressure control means sets the fuel pressure on a high pressure side excluding at least one of a maximum fuel pressure and a minimum fuel pressure in the pressure accumulation chamber as the abnormal condition target fuel pressure when the fuel pressure sensor is diagnosed as being in the abnormal condition.

9. A fuel pressure control device for an internal combustion engine according to claim 1, further comprising:

an electronically controlled throttle valve for adjusting an intake amount of the air supplied to the combustion chamber;

an accelerator position sensor for detecting a depression amount of an accelerator pedal; and throttle position control means for controlling the position of the electronically controlled throttle valve in correspondence with the depression amount of the accelerator pedal, wherein when the fuel pressure sensor is diagnosed as being in the abnormal condition, the throttle position control means performs a filtering process to a detection value of the depression amount of the accelerator pedal, and controls the position of the electronically controlled throttle valve in correspondence with the detection value after the filtering process.

10. A fuel pressure control valve for an internal combustion engine according to claim 9, wherein the throttle position control means controls the position of the electronically controlled throttle valve in correspondence with the detection value after the filtering process, in response to only the depression amount in the opening direction of the electronically controlled valve.

* * * * *